US007189054B2

(12) United States Patent
Addie

(10) Patent No.: US 7,189,054 B2
(45) Date of Patent: Mar. 13, 2007

(54) SELF-COMPENSATING CLEARANCE SEAL FOR CENTRIFUGAL PUMPS

(75) Inventor: Graeme R. Addie, Martinez, GA (US)

(73) Assignee: GIW Industries, Inc., Grovetown, GA (US)

( * ) Notice: Subject to any disclaimer, the term of this patent is extended or adjusted under 35 U.S.C. 154(b) by 148 days.

(21) Appl. No.: 10/984,163

(22) Filed: Nov. 9, 2004

(65) Prior Publication Data

US 2005/0123395 A1 Jun. 9, 2005

Related U.S. Application Data

(60) Provisional application No. 60/526,270, filed on Dec. 3, 2003.

(51) Int. Cl.
*F16J 15/46* (2006.01)
*F01D 11/04* (2006.01)

(52) U.S. Cl. ..... 415/110; 415/172.1; 415/174.3; 415/174.4; 277/369; 277/387

(58) Field of Classification Search ..... 415/172.1, 415/173.1, 173.3, 173.6, 110, 174.1, 174.3
See application file for complete search history.

(56) References Cited

U.S. PATENT DOCUMENTS 2,109,679 A * 3/1938 Neveling, Sr. ..... 384/132
2,679,412 A 5/1954 Whitfield
2,736,265 A 2/1956 Higgins
2,925,290 A 2/1960 Greenwald
3,272,572 A 9/1966 Lloyd
3,516,757 A * 6/1970 Baumann ..... 415/112
4,126,360 A * 11/1978 Miller et al. ..... 384/117
4,913,619 A * 4/1990 Haentjens et al. ..... 415/172.1
5,921,748 A * 7/1999 Frater ..... 415/172.1
5,971,704 A 10/1999 Blattmann
6,739,829 B2 * 5/2004 Addie ..... 415/1

FOREIGN PATENT DOCUMENTS

JP 45-33481 10/1970

* cited by examiner

*Primary Examiner*—Edward K. Look
*Assistant Examiner*—Devin Hanan
(74) *Attorney, Agent, or Firm*—Womble Carlyle Sandridge & Rice, PLLC

(57) ABSTRACT

A radial seal is provided for installation within a centrifugal pump of the type having an impeller, a pump casing having a suction inlet, a sealing ring groove formed in the pump casing, and means for supplying flushing water to the sealing ring groove. The radial seal comprises a seal body, including a sealing end, a water inlet end, and opposed sides. The sealing end has an outwardly extending lip portion. The seal is adapted for installation within the sealing ring groove, with openings formed through the seal body for the passage of water.

23 Claims, 9 Drawing Sheets

SELF-COMPENSATING CLEARANCE SEAL FOR CENTRIFUGAL PUMPS

RELATED APPLICATIONS

This non-provisional application claims the benefit of Provisional application No. 60/526,270, filed Dec. 3, 2003, now pending, the content of which is incorporated herein in its entirety.

FIELD OF THE INVENTION

This invention relates generally to centrifugal pumps, and, more particularly, to lubricating pump seals for centrifugal pumps, which seals act to reduce wear between the rotating and stationary surfaces of pumps that are used to pump a mixture of solids and carrier liquid, commonly known as slurry.

BACKGROUND OF THE INVENTION

Centrifugal pumps employ centrifugal force to lift liquids from a lower to a higher level or to produce a pressure. Such pumps typically comprise an impeller consisting of a connecting hub with a number of vanes and shrouds, rotating in a volute collector or casing (See FIGS. 1 and 2). Liquid is drawn into the center of the impeller and is picked up by the vanes and accelerated to a high velocity by rotation of the impeller. The liquid is then discharged by centrifugal force into the casing and out the discharge branch of the casing. When liquid is forced away from the center of the impeller, a vacuum is created, causing more liquid to flow into the center of the impeller. Consequently there is a continuous flow through the pump.

The rotation of the impeller vanes results in a higher pressure in the volute collector than in the suction, which results in flow. This higher pressure has to be sealed against the lower pressure suction on one side and where the shaft (at a lower atmospheric pressure) on the other side enters the collector, to avoid leakage losses and loss of performance. In the case of the shaft, the most common sealing method is to utilize a stuffing box with rings of packing. On the front, or suction side, the most common method of sealing is to utilize a close radial clearance between the impeller and the casing and to employ radial seal rings. For pumps used to pump slurry, however, the sealing problem is more difficult. While radial seal rings are effective in clean water pumping applications, experience with slurry pumps has shown that the particles (solids) being pushed through the gap between the sealing surfaces are thrown off the rotating radial surface of the impeller seal ring, causing high wear to the wetted surfaces of the pump.

Wear occurs mostly as a result of particles impacting or sliding on the wetted surfaces. The amount of wear depends on the particle size, shape, specific gravity of the solids, and sharpness of the solids.

In order to reduce wear, some pumps employ a water flush to dilute and exclude solids, some utilize semi-axial gaps tapering inwardly at an angle, and some utilize clearing vanes protruding out of the front shroud of the impeller into the gap between the impeller and the suction liner, or combination of the above. Each of these, however, has either not satisfactorily solved the problem of wear, or has reduced wear at the expense of pump efficiency.

What is needed, then, is a pump seal that is simple, effective in reducing wear, and that does not impair the performance of the pump.

SUMMARY

The present invention is directed to a radial seal for centrifugal pumps. Specifically, the sealing assembly is adaptable for use in a centrifugal pump of the type used for pumping an abrasive slurry where wear due to particulate matter is particularly problematic. The seal assembly may be installed in a pump having a sealing ring groove in the stationary pump casing and a means for supplying clean, pressurized flush water into the sealing ring groove. While the present invention may be installed on a variety of pump types, exemplary installation on a single-stage, single-suction centrifugal pump will be explained in detail herein.

One embodiment includes a radial seal that is positioned within the sealing ring groove of the stationary pump casing of a centrifugal pump. The radial seal is dimensioned to be smaller than the groove so that it may move freely within the groove. The radial (circular) seal has a generally rectangular cross section and is formed of a wear-resistant malleable iron, elastomer, or ceramic material.

The radial seal comprises: a flushing water inlet, or outer, end; a sealing, or inner, end; and opposed sides. The radial seal is dimensioned to fit within the sealing ring groove in the pump casing. Multiple openings extend from the water inlet end to the sealing end of the seal for the passage of pressurized water therethrough.

When pressurized water is applied to the water inlet end of the seal, the seal will move to a self-compensating, balanced position between the pump casing and the impeller of the pump. The inventors have found that this balanced condition is approximately defined by the following equation:

$$P_I{}^*A_I=P_{MEAN}{}^*A_S.$$

Hydrostatically, as the seal approaches the surface of the impeller, backpressure between the impeller and the radial seal increases. The sealing end of the radial seal also includes a lip portion that extends outwardly so that the area of the sealing end is larger than the area of the water inlet end. This relationship between seal areas and pressures helps to balances the seal so that the seal does not physically contact the impeller.

In another embodiment, the sealing end of the seal of the present invention has a centrally-formed recessed region. Desirably, it creates a "shower head", or conical, distribution of flush water. Formed in this fashion, the flush water is caused to spread out from the perforations onto an even larger predetermined surface area. When the flush water enters the recessed portion, pressure in the recessed portion builds, again balancing the hydrostatic force between the seal and the impeller surface, so that the seal moves outward, but never actually contacts the impeller.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed.

DETAILED DESCRIPTION OF THE PREFERRED EMBODIMENTS

Certain exemplary embodiments of the present invention are described below and illustrated in the attached Figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art, and all such alternate embodiments, modifications and improvements are within the scope of the present invention.

Figure 1:
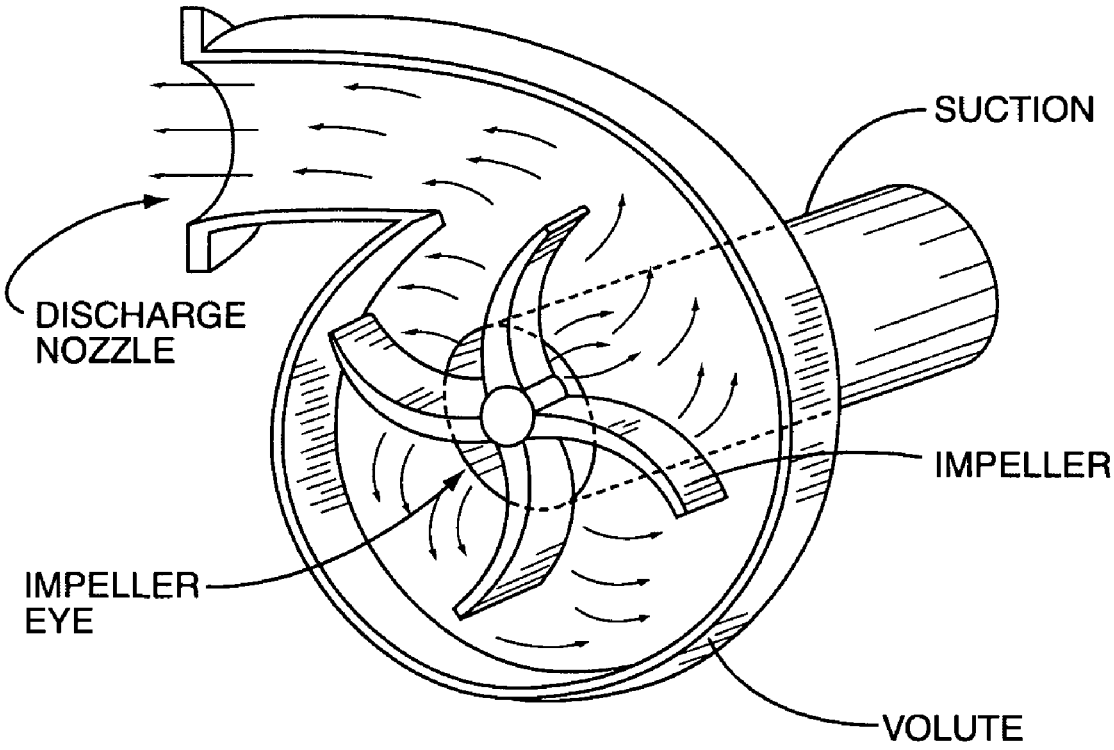
PRIOR ART FIG. 1
FIG. 1 is a simplified schematic illustrating the fundamental components and operation of a conventional single stage centrifugal pump.
Figure 2:
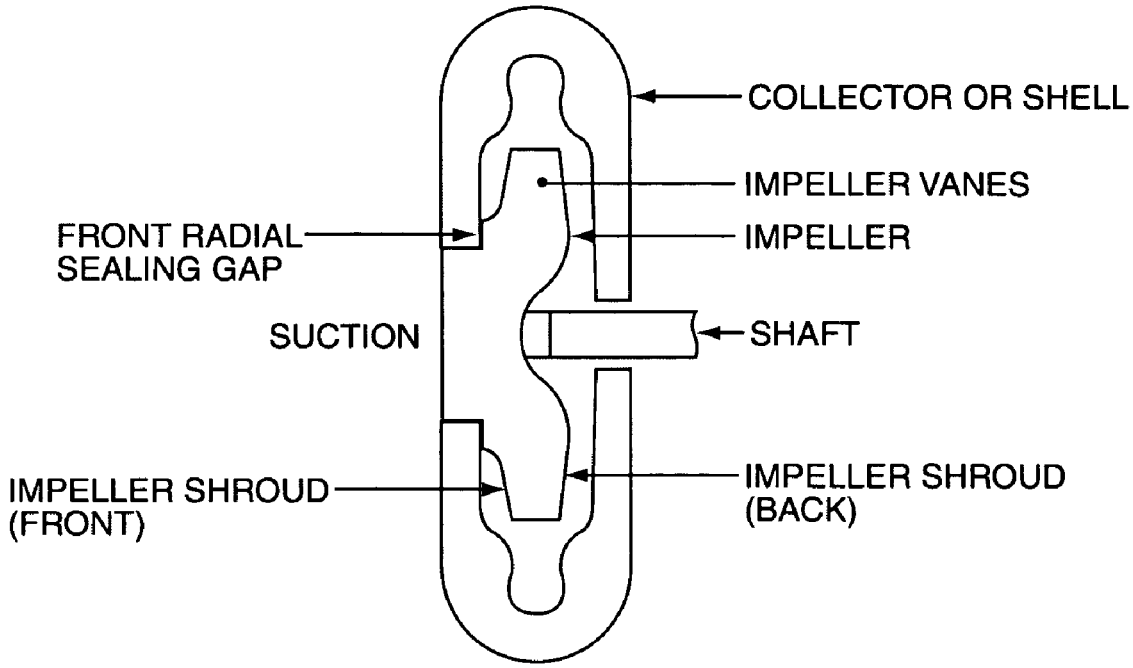
PRIOR ART FIG. 2
FIG. 2 is a cross-sectional view of the interior of a conventional single stage centrifugal pump.
Figure 3:
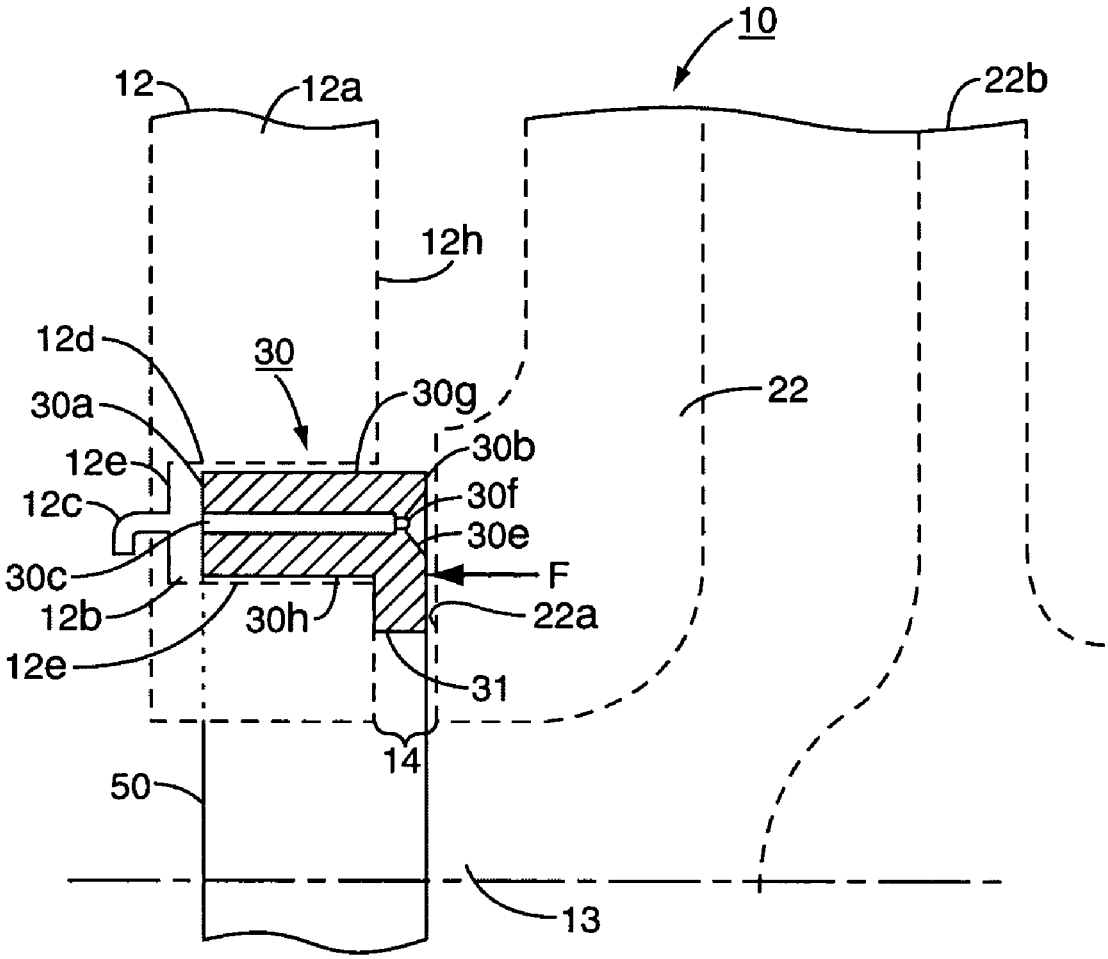
FIG. 3 is a close-up cross-sectional side view of the radial sealing gap area of FIG. 2, illustrating the placement of the seal of the present invention.

Referring now to FIG. 3, a close-up sectional view is shown of the impeller nose gap 14 and pump casing sealing surfaces 12*h* for a single-suction, single-stage centrifugal slurry pump, designated generally as 10.

Pump 10 comprises a stationary casing, or volute, 12 that houses the single impeller 22. As is conventional for centrifugal pumps, impeller 22 is rotated by a shaft (not shown) that is coupled to a motive power source (not shown) such as an electric motor. Aligned axially with impeller 22 is the pump suction inlet 13. Suction inlet 13 is the point of entry for slurry being drawn into the impeller 22. Suction inlet 13 is typically coupled to a suction source via piping (not shown) that mates with a suction flange surrounding suction inlet 13. Slurry enters the suction inlet and moves inwardly through the length of the suction branch to the eye 22*a* of the impeller 22. The counterclockwise rotation of the impeller 22 pushes the slurry on the back of the impeller vanes 22*b*, imparting radial motion and pressure to the slurry. The slurry is forced outward through a conventional casing discharge branch (not shown) that is typically connected to discharge piping. Depending upon the size of the pump and the rotational velocity of the impeller 22, hundreds or thousands of gallons per minute of slurry are drawn inwardly through the suction inlet 13 and discharged outwardly under pressure.

As shown in FIG. 3, the radial seal 30 of the present invention is shown installed in the stationary pump casing 12 of the centrifugal slurry pump. As shown, the rotating component, i.e., the impeller 22, is conventional and requires no modification. The suction side 12*a* of the pump casing 12, also commonly referred to as the suction liner, has a continuous and circular sealing ring groove 12*b* formed therein with a generally rectangular cross section for receiving the radial seal 30. As used herein, the term "radial seal" refers to any type of seal or gasket that is positioned within a holding groove for sealing the wetted surfaces of the casing 12 and impeller 22. Also, as used herein, the term "sealing" refers to the function of reducing leakage or flow between component surfaces. As will be appreciated by those skilled in the art, a complete elimination of leakage or flow between surfaces is not desirable in certain applications.

Groove 12*b* is preferably dimensioned with a depth that is greater than its width. Thus, the groove stably maintains the radial seal 30 in position, without the possibility of any substantial distortion or rotation. At least one water inlet connection 12*c* is provided so that a supply of pressurized clean water may be injected into the groove 12*b* during pump operation or wet layup. As used herein, "clean water" refers to water that is substantially free of solid matter.

Figure 4:
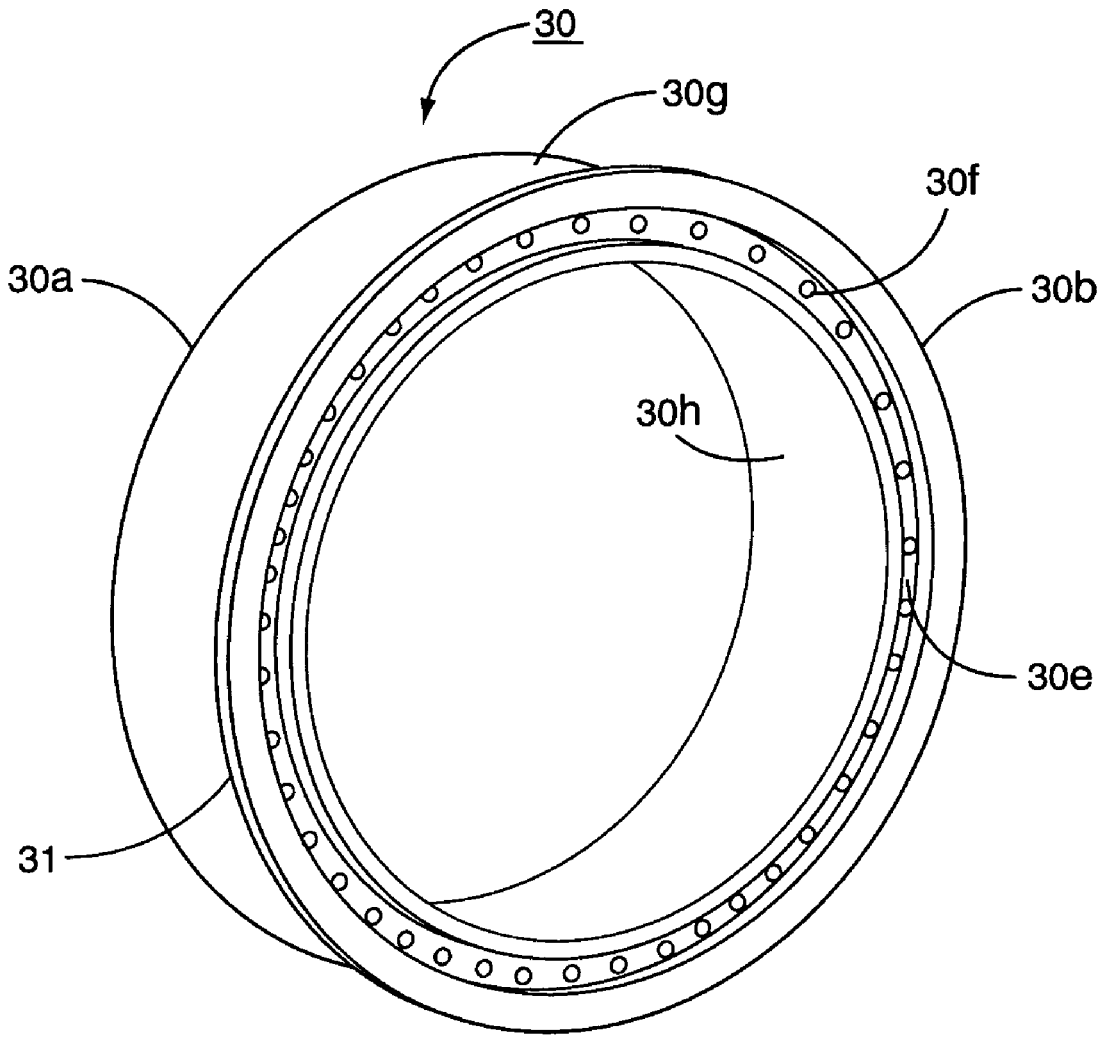
FIG. 4 is a front perspective view of the entire radial seal ring of the present invention with a conical sealing surface and perforations formed through the seal sides and sealing surface.

The complete radial seal 30 is best shown in FIG. 4. The seal 30 is formed of a durable elastomer, ceramic, or malleable metal, such as iron that has a high level of corrosion resistance; however, the selection of materials is not limited thereto. While there is no requirement that the seal material be particularly corrosion resistant because of the continuous flushing with clean water, corrosion resistant materials do, however, increase the service life of the seal 30. The seal 30 is formed as a continuous circular ring. It is sized to be slightly smaller in each dimension than groove 12*b* so that it can move freely laterally within groove 12*b*, but so that it will not twist or otherwise distort. For example, a seal 30 having a thickness of about 1.000 inch and a depth of about 1.500 inches would be seated in a groove 12*b* having a width of about 1.020 inches and a depth of about 2.000 inches. As explained in greater detail below, the sealing end of the seal 30 has a thickness dimension that is greater than the width of the groove 12*b*.

As noted, the clearance between seal 30 and the groove 12*b* is such as to allow easy movement and to minimize leakage in the gap. A version of this can have "0" rings in additional grooves (not shown) or other type of side seals to improve sealing. As shown in FIGS. 3 and 4, seal 30 has an outer, water inlet end 30*a* seated within groove 12*b*, an inner, sealing end 30*b*, and opposed sides 30*g* and 30*h*. The water inlet end 30*b* defines a water inlet end area, $A_I$. The sealing end 30*b* defines a sealing end area, As, with respect to the impeller nose surface 22*a*. As best shown in FIG. 3, the sealing end 30*b* further includes a lip portion 31. As shown in the Figures and as will be described in greater detail below, the sealing end 30*b* defines an area that is greater than the water inlet end 30*a* area; i.e., $A_S > A_I$. A series of spaced apart openings 30*c* are formed around the circumference of the water inlet end 30*a* of seal 30 and extend through the body of the seal 30. These openings 30*c* permit entry and passage of pressurized sealing water entering through inlet 12*c*. As the sealing water passes through an opening 30*c*, it is forced outward through perforations 30*f* that are formed through the sealing end 30*b*. Openings 30*c* and perforations 30*f* are sized so that a backpressure is maintained within groove 12*b* between seal 30 and the inner end 12*e* of groove 12*b*. Because the dimensions of openings 30*c* and 30*f* are limited, the application of pressurized flushing water into opening 30*c* creates a "spray nozzle" effect, forcing seal 30 inward toward impeller nose surface 22*a*. Opening 30*c* is sized between 10 percent and 80 percent of the width of the seal.

Figure 6:
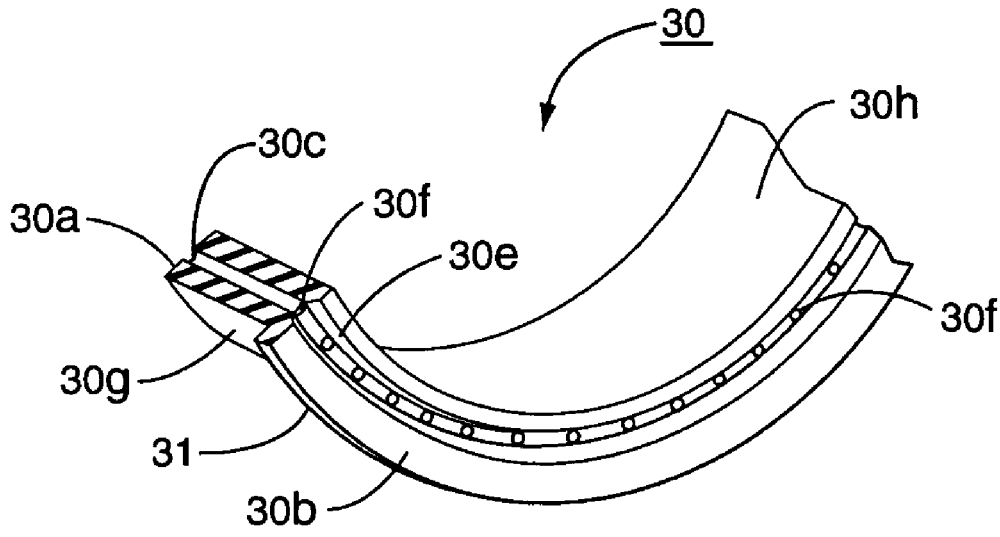
FIG. 6 is a cut-away perspective view of an alternative embodiment of the seal ring of the present invention with a recessed sealing end.
Figure 5:
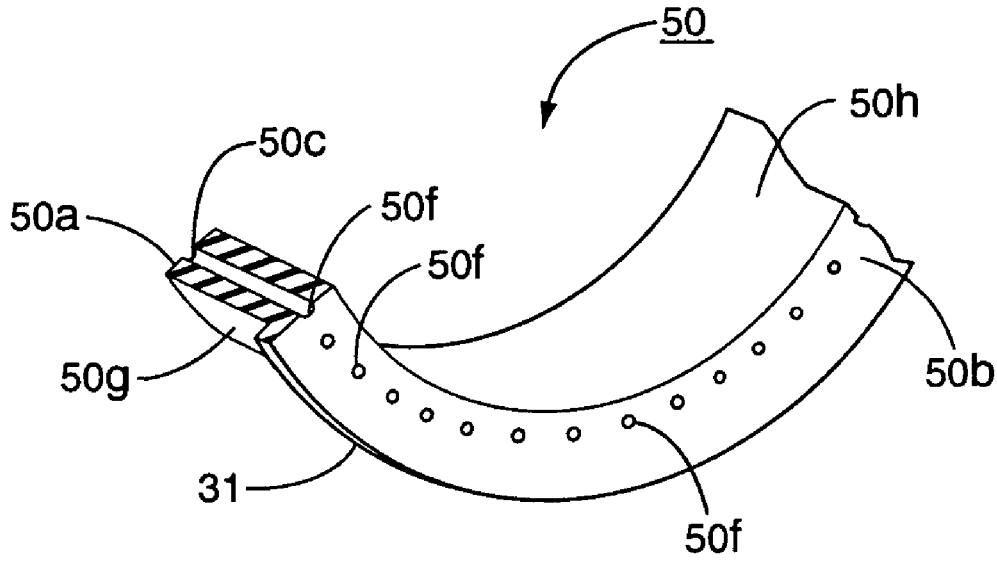
FIG. 5 is a cut-away perspective view of the seal ring of the present invention with a substantially planar sealing surface.

Turning now to FIGS. 5 and 6, two exemplary embodiments of the seal 30, 50 of the present invention are shown in cut-away sections. FIG. 5 illustrates a seal 50 having opening 50*c* for the entry of pressurized flushing water into the seal 50. The embodiment shown in FIG. 5 has a sealing end 50*b* that is substantially flat across the entire width of the seal 50. Openings 50*f* are formed through the sealing end 50*b* to communicate with opening 50*c*. A backpressure is created between seal 50 and groove 12*b* when pressurized flushing water is applied through inlet 12*c*.

As shown in FIG. 6, in a second embodiment, a substantial portion of the sealing surface of the seal 30 is recessed. FIG. 6 is a cut-away section of the seal 30 already shown in FIGS. 3, 4, and 7. As shown in FIGS. 3 and 6, the sealing end 30*b* of seal 30 has a recessed portion 30*e* centrally formed in the sealing surface 30*b*. Recessed portion 30*e* is between about 10 percent and about 30 percent of the width of the seal, or between about 0.2 inches and 1 inch in width. It has been found that with this configuration, pressurized water passing through openings 30*c* and 30*f* into the recessed portion 30*e* fills and builds pressure in recessed portion 30*e*. This ensures a substantially greater flushing and pressure balancing surface area between seal 30 and impeller nose 22*a*. While the recessed portion 30*e* is shown with a generally conical cross-section, it may be hemispherical, parabolic, etc., so long as it is completely surrounded by portions of sealing end 30*b* such that a backpressure is created when water fills the recessed portion 30*e*.

Figure 7A:
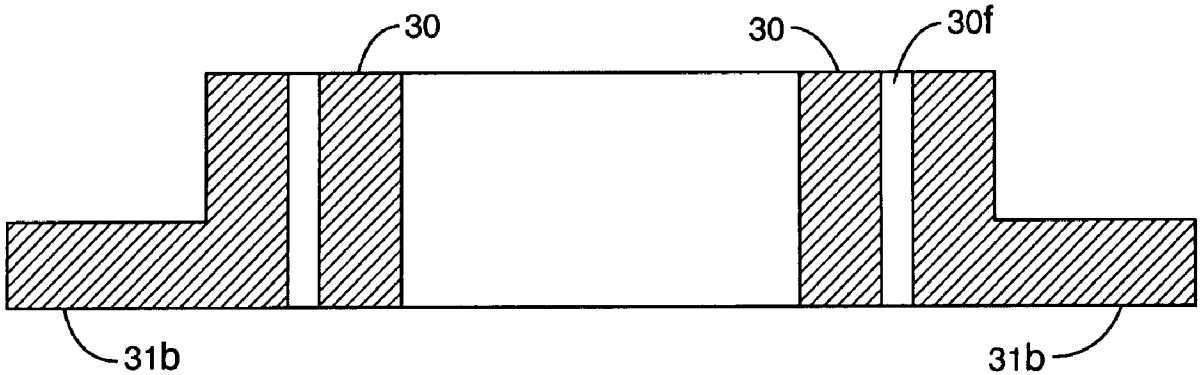
FIGS. 7A and 7B are cutaway views of the sealing ring depicting an embodiment of the ring having an extended lip portion extending toward the inlet pipe.
Figure 7B:
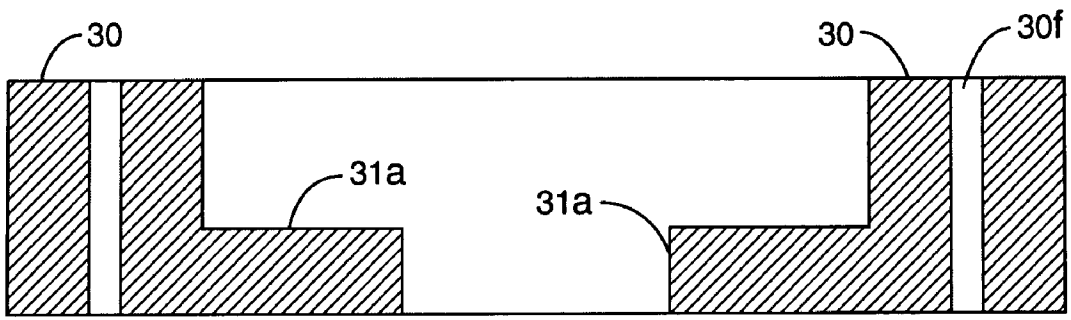
Figure 8:
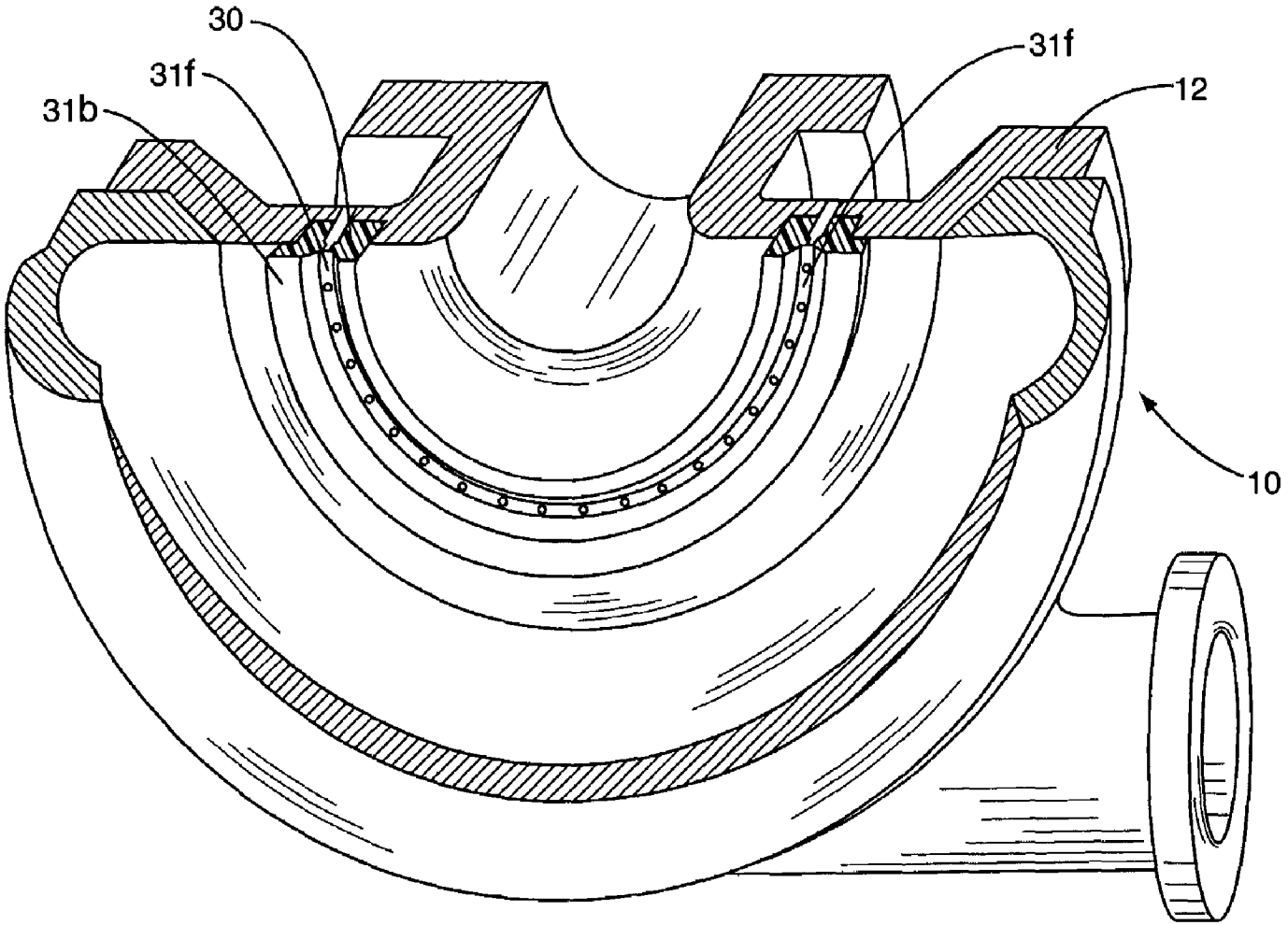
FIG. 8 is a front perspective cutaway view of the sealing ring and centrifugal pump with the extended lip portion extending away from the inlet pipe.
Figure 9:
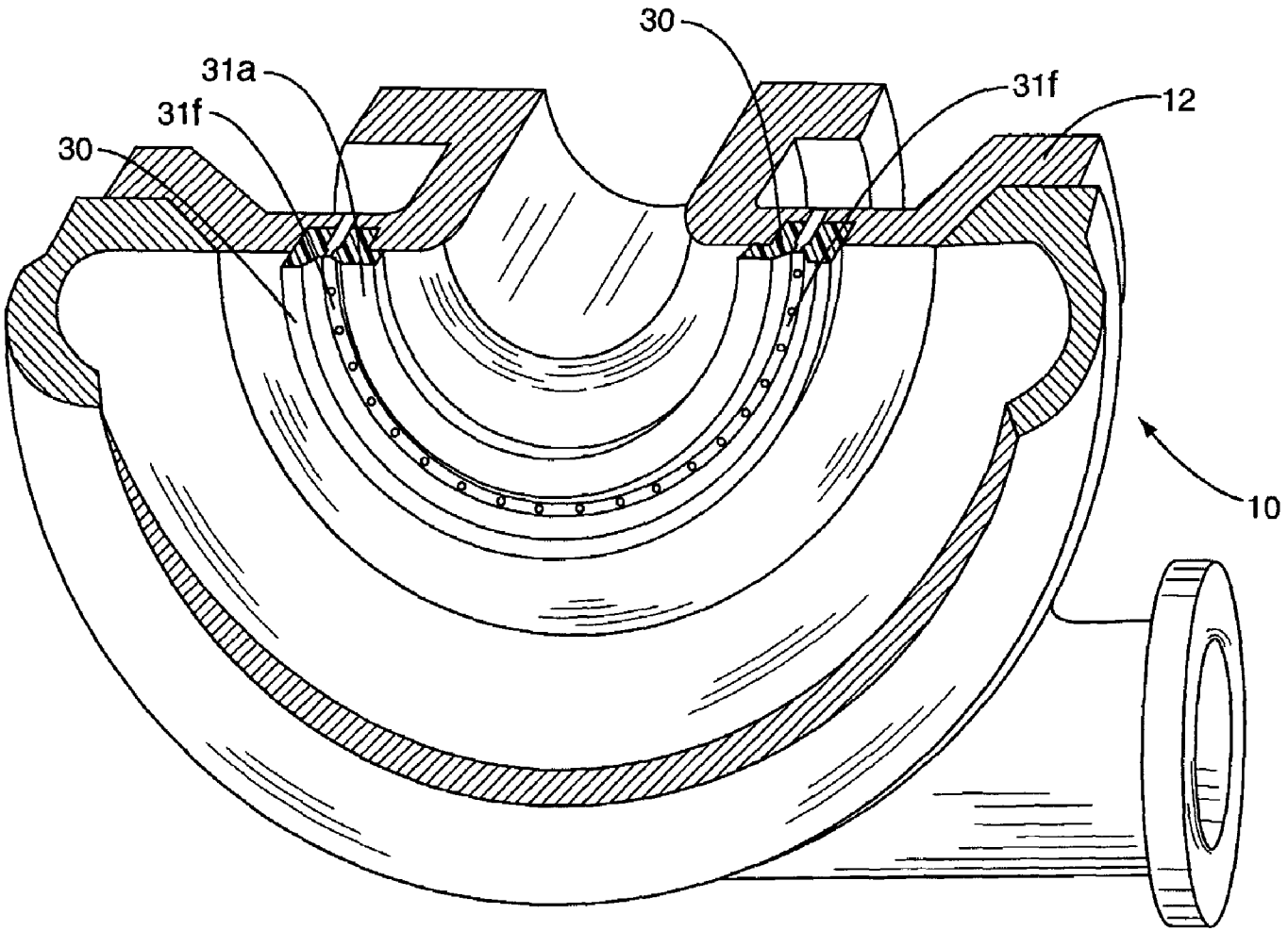
FIG. 9 is a further front perspective cutaway view of the sealing ring and centrifugal pump wherein the extended lip portion extends to the inlet pipe.

As shown in FIGS. 7 through 9, a further aspect and feature of each of the embodiments described herein is directed to a radial seal 30 having a lip portion 31*a* or 31*b* as described above. While early embodiments of the radial seal did not include a lip portion 31 extending outwardly from the sealing end 30*b*, the inventors have found that in certain applications, establishing a self-compensating balanced position is more difficult. Varying inlet water and internal pump pressures have caused the radial seals to physically contact the impeller nose surface 22*a*, which is undesirable.

The inventors have now found, however, that a self-compensating balanced position between the pump casing and the pump impeller is ensured when the sealing end area, $A_S$ is greater than the water inlet area, $A_I$. The extended lip portion 31*a* may extend inwardly toward the suction inlet 13, as illustrated in FIGS. 7B and 9; alternatively, the lip portion 31*b* may extend outwardly away from the suction inlet 13 as illustrated in FIGS. 7A and 8. Further, a seal may comprise two lip portions (not shown) that extend inwardly toward the suction inlet 13 and outwardly away from the suction inlet 13.

Figure 10:
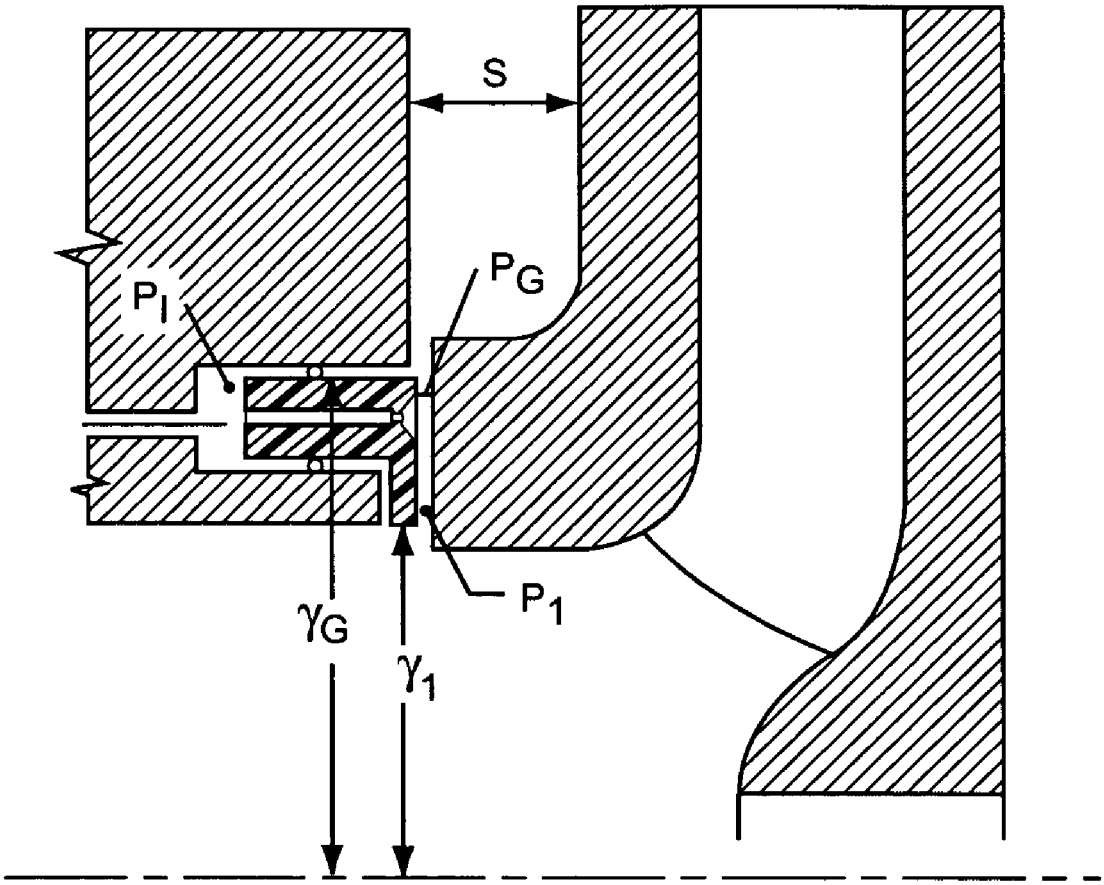
FIG. 10 illustrates the variables of the equations set forth in the present specification as they relate to the seal.

In further detail, the self compensating feature of the seal, including water being injected through the holes of the seal, is illustrated by the following equations. The variables of the equations are further defined in FIG. 10. The equations assume a linear pressure drop in the impeller nose gap. The axial force, F, acting on the radial seal has been determined as:

$$F = \frac{\pi}{3}(\gamma_G^2 - \gamma_1^2)\left(P_G + P_1 + \frac{P_G\gamma_G + P_1\gamma_1}{\gamma_G + \gamma_1}\right)$$

The corresponding mean pressure within the impeller nose gap has been determined as:

$$P_{MEAN} = \overline{P} = \frac{1}{3}\left(P_G + P_1 + \frac{P_G\gamma_G + P_1\gamma_1}{\gamma_G + \gamma_1}\right)$$

Where:

$P_G = P_1 + P_{st2} - \Delta P_{vol}$ $P_1$=static pressure at the suction inlet of the impeller $P_{st2}$=static impeller head (pressure).

$\Delta P_{vol}$=pressure drop in the side space between $\gamma_2$ and $\gamma_G$ due to the rotation of the fluid.

The self-compensating, balanced position of the radial seal is the relative radial seal position that is defined by the following equation:

$$P_C * A_I = P_{MEAN} * A_S.$$

Where:

$P_C$=pressure on the inlet side of the seal when water pressure is applied.

$A_I$=area of the water inlet end of the radial seal.

$A_S$=area of the sealing end of the radial seal.

Typically, when pressurized flush water is applied, $P_I > P_{MEAN}$; therefore, the self-compensating balanced position is obtained by compensating with a sealing area, $A_S$, that is greater than the water inlet area, $A_I$. When $P_I * A_S = P_{MEAN} * A_S$, the force acting on the radial seal is zero.

If $P_I * A_I > P_{MEAN} * A_S$, the radial seal will be pushed forward and the gap between the pump casing and the impeller nose, as well as the leakage flow rate, will then decrease. The radial seal ring will stop moving forward, when again $P_I * A_I > P_{MEAN} * A_S$.

The following example, with assumed values, illustrates how the self-compensating, balanced radial seal operates:

$\gamma_1$=525 mm;

$\gamma_G$=625 mm;

AS=90,320 mm$^2$;

AI=40,000 mm$^2$;

P1=50 kPa;

$P_G$=340 kPa;

$P_{st2}$;=300 kPa and $\Delta P_{vol}$=20 kPa.

Solving for $P_C$, the self-compensating balanced position of the radial seal will occur when $P_C$ reaches a value of approximately 438 kPa.

As those skill in the art will appreciate, there are unlimited combinations of pressures, $P_G$, $P_C$ and areas, $A_I$, $A_S$ that may be employed in constructing a radial seal according to the present invention.

In operation, pressurized water is injected into groove 12*b* through inlet 12*c*. Desirably, the pressure of the water is between about 1 and 20 pounds per square inch greater than the discharge pressure of the pump. The water passes through openings 30*c*, 50*c* and outward through perforations 30*f*, 50*f*. With the sizes of the perforations 30*f*, 50*f* restricted, the pressure of the sealing water forces the seal 30, 50 laterally outward and into gap 14, defined by the inner surface 12*h* of casing 12*a* and impeller nose surface 22*a* of impeller 22. As seal 30, 50 protrudes outwardly toward surface 22*a*, the seal water forced through the perforations 30*f*, 50*f* creates a backpressure between seal surface 30*b*, 50*b* and impeller nose surface 22*a*. The backpressure between the opposed surfaces keeps the seal 30, 50 from actually contacting impeller nose surface 22*a*. Thus, the pressurized seal arrangement of the present invention creates a self-compensating clearance between the opposed surfaces 30*b*, 50*b* and 22*a*. As surfaces 30*b*, 50*b* are not in contact, there is no frictional seal wear on either the casing 12 or the impeller 22 caused by solid contact. Further, the pressurized water provides a lubricating and cleaning medium for the wetted surfaces of the centrifugal slurry pump 10.

Although the present invention has been described with preferred embodiments, it is to be understood that modifications and variations may be utilized without departing from the spirit and scope of the invention, as those skilled in the art will readily understand. Such modifications and variations are considered to be within the purview and scope of the appended claims and their equivalents.

I claim:

1. A radial seal for installation within a centrifugal pump of the type having an impeller, a pump casing having a suction inlet, a sealing ring groove formed in the pump casing, and means for supplying flushing water to the sealing ring groove, comprising:

a seal body, including (a) a sealing end having at least one substantially planar outermost surface, said sealing end having at least one of an upwardly and downwardly extending lip portion, the lip portion having an outer surface substantially coplanar with the at least one outermost surface of the sealing end;

(b) a water inlet end;

(c) opposed sides, said seal adapted for installation within said sealing ring groove, said seal body having a plurality of openings formed therethrough for the passage of water; and (d) wherein said radial seal is movable to a self-compensating balanced position between said casing and said impeller of said pump.

2. The seal of claim 1, wherein:

(a) said sealing end defines a sealing end area, $A_s$; and (b) said water inlet end defines a water inlet end area, $A_I$, wherein said sealing end area is larger than said water inlet end area.

3. The seal of claim 1 wherein a cross-section of the radial seal is substantially L-shaped.

4. The seal of claim 1 wherein the sealing end of said radial seal is substantially flat.

5. The seal of claim 1 wherein the sealing end of the radial seal includes a recessed portion formed therein.

6. The seal of claim 5 wherein said recessed portion is substantially conical.

7. The seal of claim 5 wherein said recessed portion is substantially hemispherical.

8. The seal of claim 5 wherein said recessed portion is substantially parabolic.

9. The seal of claim 1 wherein the radial seal is formed of a material selected from the group of materials consisting of a wear-resistant iron, an elastomer, and a ceramic.

10. A centrifugal pump of the type used for pumping an abrasive slurry, comprising:

(a) a pump having a casing having a suction inlet, at least one impeller housed within said casing, a sealing ring groove formed in said casing, and means for supplying flushing water;

(b) a radial seal, comprising a seal body including:

(i) a sealing end having at least one substantially planar outermost surface, said sealing end having at least one of an upwardly and downwardly extending lip portion, the lip portion having an outer surface substantially coplanar with the at least one outermost surface of the sealing end;

(ii) a water inlet end; and (iii) opposed sides, said seal adapted for installation within said sealing ring groove, said seal body having a plurality of openings formed therethrough for the passage of water; and (iv) wherein said radial seal is movable to a self-compensating balanced position between said casing and said impeller of said pump.

11. The centrifugal pump of claim 10, wherein:

(a) said sealing end defines a sealing end area, $A_s$; and (b) said water inlet end defines a water inlet end area, $A_I$, wherein said sealing end area is larger than said water inlet end area.

12. The centrifugal pump of claim 11 wherein said self-compensating balanced position of said radial seal is defined by the equation:

$$P_I{}^*A_I = P_{MEAN}{}^*A_s, \text{ wherein}$$

$P_I$ is value of water pressure applied on said water inlet end of said radial seal, and $P_{MEAN}$ is the mean pressure on said sealing end of said radial seal.

13. The centrifugal pump of claim 10, wherein said lip portion extends outwardly toward said suction inlet.

14. The centrifugal pump of claim 10, wherein said lip portion extends outwardly away from said suction inlet.

15. The centrifugal pump of claim 11 wherein said water inlet end of the radial seal is dimensioned smaller than said sealing ring groove, and can move inwardly and outwardly within said sealing ring groove.

16. The centrifugal pump of claim 10 wherein a cross-section of said radial seal is substantially L-shaped.

17. The centrifugal pump of claim 10 wherein said sealing end of said radial seal is substantially flat.

18. The centrifugal pump of claim 10 wherein said sealing end of said radial seal includes a recessed portion formed therein.

19. The centrifugal pump of claim 18 wherein said recessed portion is substantially conical.

20. The centrifugal pump of claim 18 wherein said recessed portion is substantially hemispherical.

21. The centrifugal pump of claim 18 wherein said recessed portion is substantially parabolic.

22. The centrifugal pump of claim 10 wherein said plurality of openings are so dimensioned that pressurized water forces said radial seal outward from said groove and toward said impeller, while permitting the water to flow through said openings.

23. The centrifugal pump of claim 10 wherein said radial seal is formed of a material selected from the group of materials consisting of a wear-resistant iron, an elastomer, and a ceramic.

* * * * *